US005378493A

United States Patent [19]

Zivkovic

[11] Patent Number: 5,378,493

[45] Date of Patent: Jan. 3, 1995

[54] CERAMIC WELDING METHOD WITH MONITORED WORKING DISTANCE

[75] Inventor: Alexandre Zivkovic, Brussels, Belgium

[73] Assignee: Glaverbel, Brussels, Belgium

[21] Appl. No.: 953,870

[22] Filed: Sep. 30, 1992

[30] Foreign Application Priority Data

Oct. 15, 1991 [GB] United Kingdom ..... 9121880

[51] Int. Cl.[6] ..... B05D 1/08

[52] U.S. Cl. ..... 427/8; 427/453; 118/713; 264/30

[58] Field of Search ..... 427/8, 452, 453; 118/713; 264/30

[56] References Cited

U.S. PATENT DOCUMENTS

| | | | |
|---|---|---|---|
| 4,218,989 | 8/1980 | Fujita et al. | 118/713 |
| 4,301,998 | 11/1981 | Rodway | 118/713 |
| 4,649,858 | 3/1987 | Sakai et al. | 118/697 |
| 5,047,612 | 9/1991 | Savkar et al. | 219/121.47 |
| 5,100,594 | 3/1992 | Zvosec et al. | 427/427 |

FOREIGN PATENT DOCUMENTS

| | | |
|---|---|---|
| 0039212 | 4/1981 | European Pat. Off. . |
| 0115710 | 8/1984 | European Pat. Off. . |
| 0211372 | 2/1987 | European Pat. Off. . |
| 2411382 | 6/1979 | France . |
| 1330894 | 9/1973 | United Kingdom . |
| 2110200 | 6/1983 | United Kingdom . |
| 2154228 | 9/1985 | United Kingdom . |

OTHER PUBLICATIONS

Moran, A. L., et al., "Developing Intellegen . . . ", *JOM*, vol. 42, No. 7, Jul., 1990, pp. 21–24.

*Primary Examiner*—Shrive Beck
*Assistant Examiner*—Katherine A. Bareford
*Attorney, Agent, or Firm*—Spencer, Frank & Schneider

[57] ABSTRACT

The invention concerns a ceramic welding process in which a mixture of refractory and fuel particles is projected from an outlet at an end of a lance in a gas stream against a target surface where the fuel particles combust in a reaction zone to produce heat to soften or melt the projected refractory particles and thereby form a coherent refractory weld mass. A method of monitoring the distance between the lance outlet and the reaction zone is disclosed in which the reaction zone and at least part of the gap between that reaction zone and the lance outlet is monitored by a camera and an electronic signal is produced indicative of the distance ("the working distance") between the lance outlet and the reaction zone.

7 Claims, 2 Drawing Sheets

CERAMIC WELDING METHOD WITH MONITORED WORKING DISTANCE

BACKGROUND OF THE INVENTION

1. Field of the invention.

This invention relates to a ceramic welding process in which a mixture of refractory and fuel particles is projected from an outlet at an end of a lance in a gas stream against a target surface where the fuel particles combust in a reaction zone to produce heat to soften or melt the projected refractory particles and thereby form a coherent refractory weld mass. The invention extends to ceramic welding apparatus for projecting a mixture of refractory and fuel particles from an outlet at an end of a lance in a gas stream against a target surface where the fuel particles combust in a reaction zone to produce heat to soften or melt the projected refractory particles and thereby form a coherent refractory weld mass, and in particular to ceramic welding apparatus comprising a lance having an outlet for the discharge of a ceramic welding powder mixture.

Ceramic welding processes are principally used for the repair of worn or damaged refractory linings of furnaces of various types.

2. Description of the Related Art

In the ceramic welding process as commercially practised, a ceramic welding powder mixture which comprises grains of refractory material and fuel particles is projected against a refractory surface to be repaired in a carder gas stream which wholly or mainly consists of oxygen. The refractory surface is best repaired while it is substantially at its operating temperature, which may be in the range of 800° to 1300° C. or even higher. This has advantages in avoiding any need to wait for the refractory under repair to be cooled or reheated, so minimising furnace down-time, in avoiding many problems due to thermal stress in the refractory material due to such cooling and reheating, and also in promoting the efficiency of the ceramic welding reactions whereby the fuel particles bum in a reaction zone against the target surface and there form one or more refractory oxides while releasing sufficient heat to melt or soften at least the surfaces of the projected refractory grains so that a high quality weld repair mass may be built up at the repair site as the lance is played across it. Descriptions of ceramic welding processes can be found in British patent specifications GB 1330894 and GB 2110200-A.

It has been found that the working distance, that is the distance between the reaction zone at the target surface and the outlet of the lance from which the ceramic welding powder is projected, is of importance for various reasons. If that working distance is too small, there is a risk that the lance tip may enter the reaction zone so that refractory material is deposited on the end of the lance possibly blocking its outlet. There may even be a risk that the reaction could propagate back into the lance, though this possibility may be largely avoided by ensuring that the velocity of the carrier gas stream exiting the lance is higher than the speed of propagation of the reaction. There are also the possibilities that the lance may become overheated due to its close proximity to the reaction zone, and that it may contact the target surface again leading to possible blockage of its outlet. If, on the other hand, the working distance is too great, the ceramic welding powder stream will have an opportunity to spread out so that the reaction will not be so concentrated leading to a loss in efficiency, increased rebound of material from the target surface, a weld of less high quality, and even a risk that the reaction will fail.

The optimum distance between the lance outlet and the target surface will depend on various factors. For example, in a welding operation in which ceramic welding powder is discharged at a rate of between 60 and 120 kg/hr from a lance outlet having a bore diameter of 12 to 13 ram, such optimum distance is found to be between 5 and 10 cm. That optimum distance is rarely greater than 15 cm.

Because of the high temperatures typically encountered at a repair site, the target surface and other parts of the furnace lining tend to radiate strongly in the visible spectrum, and the reaction zone is itself highly incandescent. This renders direct observation of the lance outlet difficult, and this difficulty is increased as the length of the lance increases. Indeed lances with a length of 10 meters are not unknown, and nor is it unknown to perform a welding operation at a site which is out of direct view of the welding operator.

SUMMARY OF THE INVENTION

It is an object of this invention to provide a method and apparatus whereby a welding operator may more easily control the distance between the outlet of a ceramic welding lance and a repair site.

According to this invention, there is provided, in a ceramic welding process in which a mixture of refractory and fuel particles is projected from an outlet at an end of a lance in a gas stream against a target surface where the fuel particles combust in a reaction zone to produce heat to soften or melt the projected refractory particles and thereby form a coherent refractory weld mass, a method of monitoring the distance between the lance outlet and the reaction zone, characterized in that the reaction zone and at least part of the gap between that reaction zone and the lance outlet is monitored by a camera and an electronic signal is produced indicative of the distance ("the working distance") between the lance outlet and the reaction zone.

The present invention also includes ceramic welding apparatus for projecting a mixture of refractory and fuel particles from an outlet at an end of a lance in a gas stream against a target surface where the fuel particles combust in a reaction zone to produce heat to soften or melt the projected refractory particles and thereby form a coherent refractory weld mass, characterized in that such apparatus further comprises means for monitoring the distance between the lance outlet and the reaction zone ("the working distance") which comprises a camera for monitoring the reaction zone and at least part of the gap between that reaction zone and the lance outlet and means for producing an electronic signal indicative of the working distance.

It will be apparent that by virtue of a method and apparatus according to this invention, a welding operator may make use of the electronic signal produced so that he can more easily control the distance between the outlet of a ceramic welding lance and the reaction zone at a repair site and so that he is better able to ensure the continuing achievement of optimum welding conditions. It is surprising that it is possible to obtain a control signal indicative of the working distance by using a camera in the very hot and bright environment of a furnace at its operating temperature.

In preferred embodiments of the invention, the reaction zone and at least part of the gap between that reaction zone and the lance outlet is monitored using a charge-coupled device ("CCD") camera. Such a camera may be made quite small so that it is convenient to manipulate, and its operation is convenient for the simple production of a said electronic signal indicative of the working distance. Many CCD cameras currently available have the additional advantage of being particularly sensitive to wavelengths of light which are emitted from a ceramic welding reaction zone.

The control signal may be used directly for the automatic maintenance of a correct working distance. For example a lance may be mounted on a carriage so that it is movable with respect to three perpendicular axes by three motors under the control of a computer which is fed with that signal.

Alternatively, or in addition, and as preferred, an audible and/or visual signal is generated to distinguish between operating conditions in which (a) the actual working distance falls within a tolerance range of a predetermined working distance and (b) the actual working distance falls outside such a tolerance range. The welding operator may thereby more easily control the position of the lance outlet in relation to the work when this is under manual control, or he may more easily be able to monitor an automatic welding operation.

In some embodiments of the invention, said camera is independently movable with respect to said lance and is used simultaneously to monitor the positions of said lance outlet and said reaction zone. Such embodiments of the invention can be put into practice using ceramic welding lances of known type. Appropriate positioning of the camera will enable monitoring of the working distance between the outlet end of the lance and the reaction zone. Since the lance outlet is also monitored, the size of the image of the outlet end of the lance in the focal plane of the camera may be used to give an indication of the distance between the camera and the end of the lance, and this enables the distance between the end of the lance and the reaction zone to be calculated. It is preferred that such calculation be performed automatically, and it is therefore preferred that a signal is generated proportional to the size of the image of the outlet end of the lance as monitored by said camera and that that signal is used as a scaling factor for an image of the working gap between the reaction zone and the lance outlet.

Calibration of the apparatus is much simplified when said camera is mounted in a fixed position and orientation on said lance, and the adoption of this feature is preferred.

Indeed, the invention extends to ceramic welding apparatus comprising a lance having an outlet at an end thereof for the discharge of a ceramic welding powder mixture, characterised in that such lance incorporates a fixed electronic camera directed towards a path along which such powder mixture may be discharged.

Such a lance does not need to be of particularly complicated construction and the performance of the method of the invention is also simplified since it is assured that the camera will always be pointing in the correct direction. The field of view of the camera in such embodiments may, but need not, include the outlet end of the lance, since the position of that outlet end in relation to that field of view will be known. Calibration is also greatly simplified, and can easily be performed under ambient conditions external of any furnace by laying up a graduated scale to the outlet end of the lance in alignment with the discharge path for the powder mixture and viewing that scale through the camera. Such a graduated scale may suitably take the form of a strip light which is surrounded by a mask which is perforated at intervals along its length, for example at 1 cm intervals, so that the camera can record spaced illuminated patches.

In order to protect the camera against overheating when in use, it is preferred that said camera is held within a jacket arranged and adapted for the circulation of coolant. Many embodiments of commercially used ceramic welding lances already incorporate a water jacket whose principal purpose is to prevent overheating of the lance, especially towards its outlet end, and such a water-jacket may readily be modified in order to accommodate a said camera.

Advantageously, a filter is provided for screening said camera from infra-red radiation. Cameras presently commercially available are most often not designed for converting infra-red radiation to electrical signals, so the provision of such a filter will act further to protect the camera against overheating without detracting in any way from the operation of the camera. Such a filter may for example be constituted by a thin gold film which is at least partially transparent to visible radiation but reflects a very high proportion of radiation in the infra-red spectrum.

Many such cameras are indeed blind to radiation having wavelengths greater than 900 nm, and it is found that the spectral emissivity of a typical ceramic welding reaction zone has its maximum at a wavelength below 850 nm. Thus in order to provide the maximum protection against infra-red radiation to the camera with minimum effect on its response, it is preferred that a said filter is arranged and adapted to screen said camera from radiation having wavelengths greater than 900 nm.

A further filter is preferably provided for screening said camera from radiation having wavelengths shorter than 600 nm. Such shorter wavelength radiation may be screened by means of a red filter, and this has the advantage of greatly reducing the registration by the camera of light which does not emanate from the reaction zone as such. It also reduces glare which enables the reaction zone to be more accurately monitored. In a specific practical embodiment adopting both these preferred optional features, the camera is provided with filters which substantially screen off radiation having wavelengths less than 630 or 650 nm and wavelengths greater than 850 nm so that most of the radiant energy incident on the camera has a wavelength falling within that band.

In some preferred embodiments of the invention, a filter is provided for screening said camera from radiation having wavelengths shorter than 670 nm. As the lance is played across the surface of the area under repair, there will obviously be an increment of that area which the reaction zone has just moved away from. Because of the intense heat at the reaction zone, that surface increment will have been heated strongly and it may well continue to glow brightly after the reaction zone has passed to a neighbouring part of the repair area. That residual glow may be reduced or even eliminated by the use of a sub-670 nm filter so reducing or avoiding any apparent distortion of the reaction zone as registered by the camera.

Advantageously, means is provided for supplying a current of gas to sweep across said camera. It will be appreciated that the atmosphere in the interior of a furnace which is undergoing repair is likely to be heavily laden with dust and fumes, including dust and fumes produced by the ceramic welding process itself, and the adoption of this preferred feature helps to keep the camera clear of dust and fume condensates which might otherwise blind it. The temperature of such gas is preferably such that it also has a cooling effect on the camera.

The location of such a camera on a said lance is not critical, provided that the field of view of the camera encompasses the required length of the powder discharge path. Said camera is preferably mounted on said lance at a distance between 30 and 100 cm from the lance outlet. In association with a charge-coupled device of half inch (12.7 mm) size, a 15 mm objective lens gives a field of view of 24°. If such is located 70 cm from the end of the lance, a powder discharge path length of 30 cm may be viewed.

In order to generate the signal indicative of the actual working distance at any given moment, signals corresponding to the image recorded by the camera may be passed to an analyser to determine the position of the reaction zone. This position is recognised as being that zone of the camera screen where the luminous intensity exceeds a predetermined threshold value. Following a previous calibration by which the actual spacing of two points is correlated with the spacing of the images of those points, and the position of the end of the lance with respect to the image, it is a simple matter to derive a signal which is indicative of the working distance.

Signals generated by the camera in use may be stored as an electronic image and used in various ways. That image does not in fact need to be displayed. It may for example be used for the control of a welding robot. Alternatively, or in addition, the signal indicative of the actual working distance may readily be compared electronically, after suitable calibration, with a signal corresponding to a notional optimum working distance, and any difference can be used to generate an audible signal. For example the arrangement might be such that when the lance outlet approaches the work too closely, a high pitched signal of increasing intensity is generated, while as separation between the lance outlet and the work increases a low-pitched signal of increasing intensity is generated. The aim of the welding operator would then be to keep the audible signals generated at as low a volume as possible.

It is preferred, however, that signals produced by said camera are used to generate an image on a video monitor screen. Providing a video monitor screen for displaying an image of the scene viewed by said camera enables the welding operator to gain the information he requires more easily. It is not necessary that this image should be a full two-dimensional image of the working scene. Since all the operator requires to know is the way in which a linear measurement is changing, a linear CCD camera may be mounted on the lance with consequent cost savings. Such a linear camera may also be used for generating an audible signal as aforesaid.

But it is preferred that such a camera be able to provide a full two-dimensional image. If displayed, this gives a more natural view to the welding operator, and it may also allow greater accuracy in monitoring the distance between the work and the lance outlet as will be adverted to later in this specification.

Advantageously, said video monitor screen is used to display an image of the reaction zone superimposed on a calibration scale. The provision of means for storing a calibration scale and displaying an image of that scale on said screen greatly facilitates the task of the welding operator since he can at once see how far the lance outlet is from the work and then take any corrective measures necessary.

BRIEF DESCRIPTION OF THE DRAWINGS

The invention will now be further described by way of example only with reference to the accompanying diagrammatic drawings in which.

DESCRIPTION OF THE PREFERRED EMBODIMENTS

Figure 1:
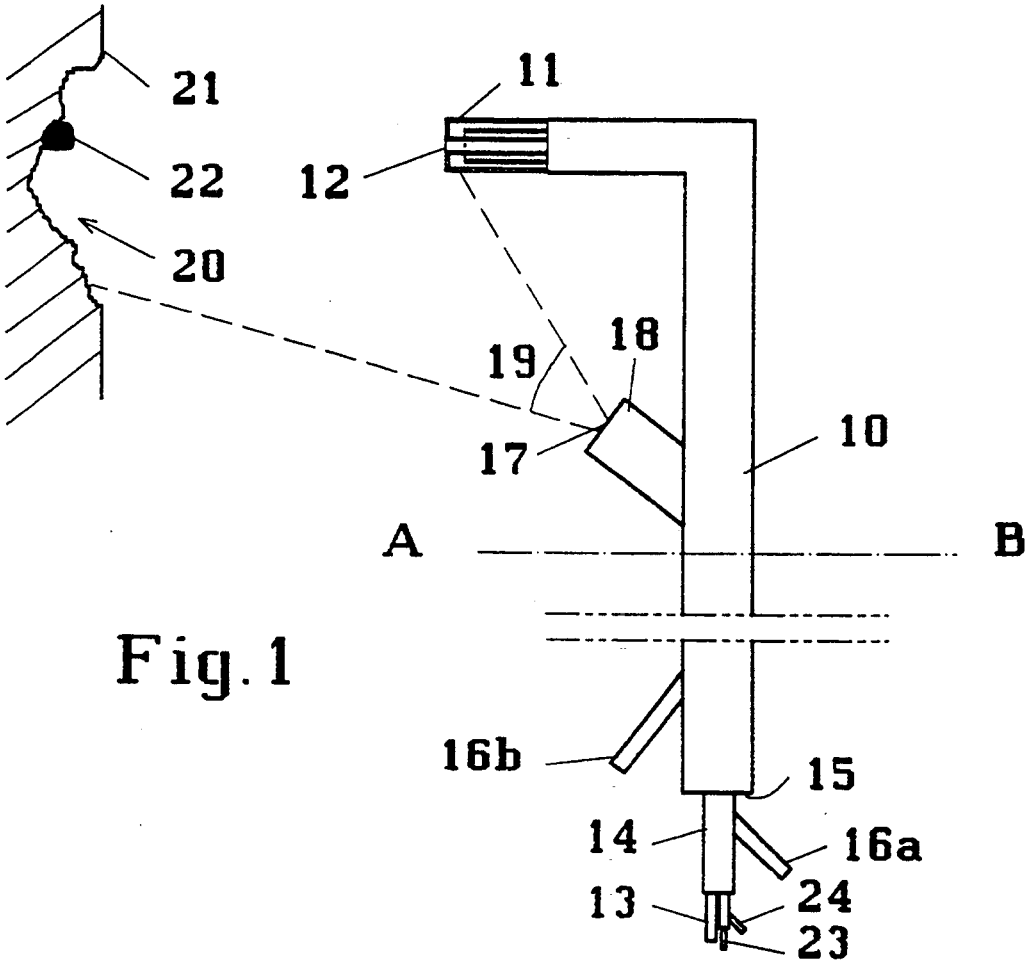
FIG. 1 is a general view of an embodiment of ceramic welding lance according to the invention whose outlet end is directed towards a wall to be repaired, with the extremity of the lance being shown in cross-section for added clarity.

In the drawings, a lance 10 has a working end 11 provided with an outlet 12 for the projection of a stream of oxygen rich carrier gas which transports a ceramic welding powder mixture.

The composition of the projected stream may depend on the nature of the surface to be repaired. For example, for repairing a silica refractory, the carrier gas may consist of commercial grade dry oxygen, and the ceramic welding powder may consist of 87% by weight silica particles having sizes of about 100 μm to 2 mm as refractory component, and 12% silicon and 1% aluminium particles both with a nominal maximum size of about 50 μm as fuel components.

Ceramic welding powder is supplied to the lance outlet 12 by a lance tube 13 which is surrounded by median and outer lance tubes 14 and 15 respectively which are in communication at the outlet end 11 of the lance. Median lance tube 14 is provided with an inlet **16*a* for the supply of coolant such as water, and outer lance tube 15 has an outlet 16*b*** for that coolant. Thus the lance is provided with a water jacket to avoid overheating.

Figure 2:
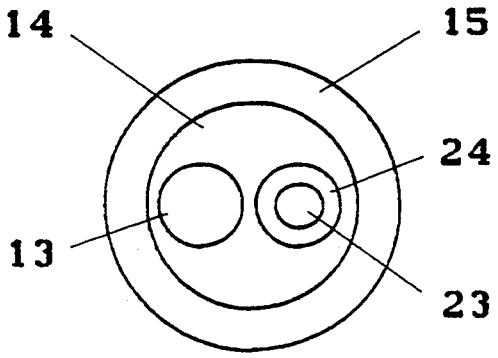
FIG. 2 is a cross-sectional view of the stem of the lance taken on the line A–B in FIG. 1.

A CCD camera 17 is located a few tens of centimeters, for example 30 to 100 cm, from the lance outlet, where it is surrounded by a short extension 18 of the water jacket. As illustrated, the field of view 19 of the camera 17 encompasses the outlet end 11 of the lance 10 and also a damaged area 20 of a refractory wall 21 which is to be repaired. A reaction zone 22 may be established against the repair site 21 as indicated. Signals from the camera 17 are passed along a cable 23 located within a pipe, having an air supply line 24, itself located within the median lance tube 14 of the water jacket. Note that the reference 24 is used for the air supply line in FIG. 1, and for the pipe itself in FIG. 2. The pipe 24 enters the water jacket extension 18 and its end is disposed so that a continuous draft of cool air is blown across the camera to keep it free from dust and fume condensates to preserve image quality, and to help cool the camera. The camera is provided with a strong red filter and a reflective filter, for example of gold, for screening off infra-red radiation so that radiation outside the wavelength band 630 (or 650) to 850 nm, preferably outside the wavelength band 670 to 850 nm, is impeded from reaching the camera.

A suitable CCD camera is that commercially available under the Trade Name ELMO Color Camera System ½" CCD image sensor, effective pixels: 579 (H)×583 (V): image sensing area: 6.5×4.85 mm: external diameter 17.5 mm by about 5 cm long. As an alternative, a colour CCD camera may be used, such as "WV-CDIE" from Panasonic or "IK-M36PK" from Toshiba.

Figure 3:
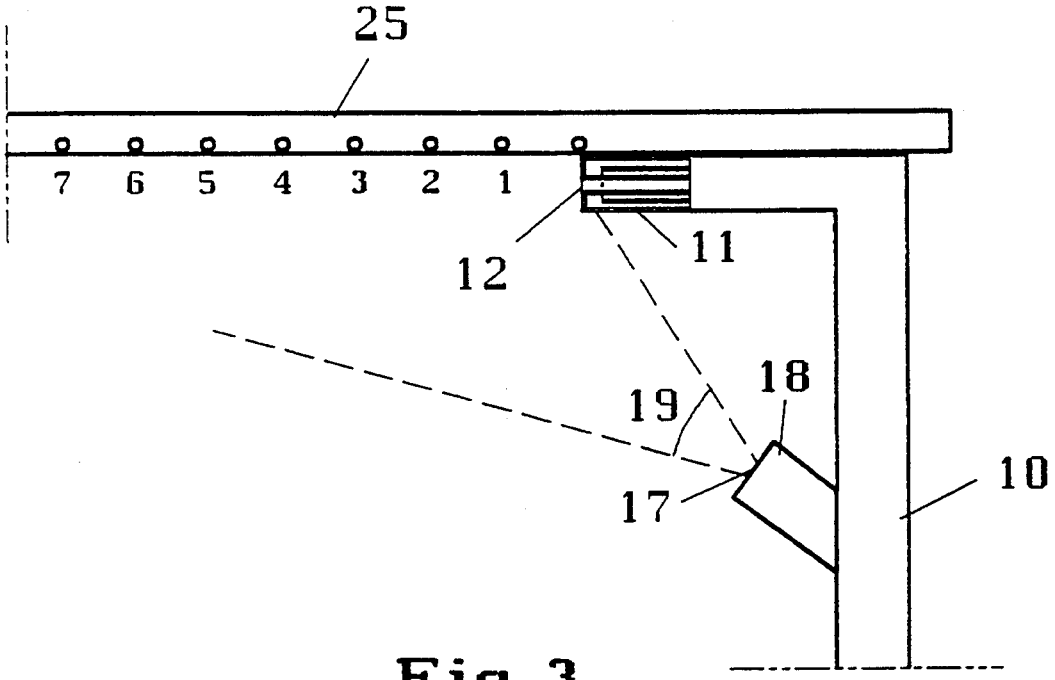
FIG. 3 illustrates a stage in the calibration of monitoring equipment associated with the lance of FIG. 1.

Such an apparatus may be calibrated very easily as illustrated in FIG. 3. A graduated scale 25 is laid up and clamped to the outlet end of the lance and is recorded by the camera 17. This may be done at the operator's convenience outside any furnace under ambient workshop conditions. Because of the rather heavy filtering with which the camera is preferably provided it is convenient to form the scale 25 as a mask for a strip light which mask is formed with regularly spaced holes such as the holes 1 to 7 which may for example be one centimeter apart. The camera will then record a line of light spots which may be displayed on a video monitor screen during performance of a ceramic welding repair. This establishes a line of datum points on the charge-coupled device of the camera which correspond with known actual distances from the outlet of the lance, and this enables a correlation to be established between each pixel of the camera image and an actual distance from the lance outlet.

Figure 4:
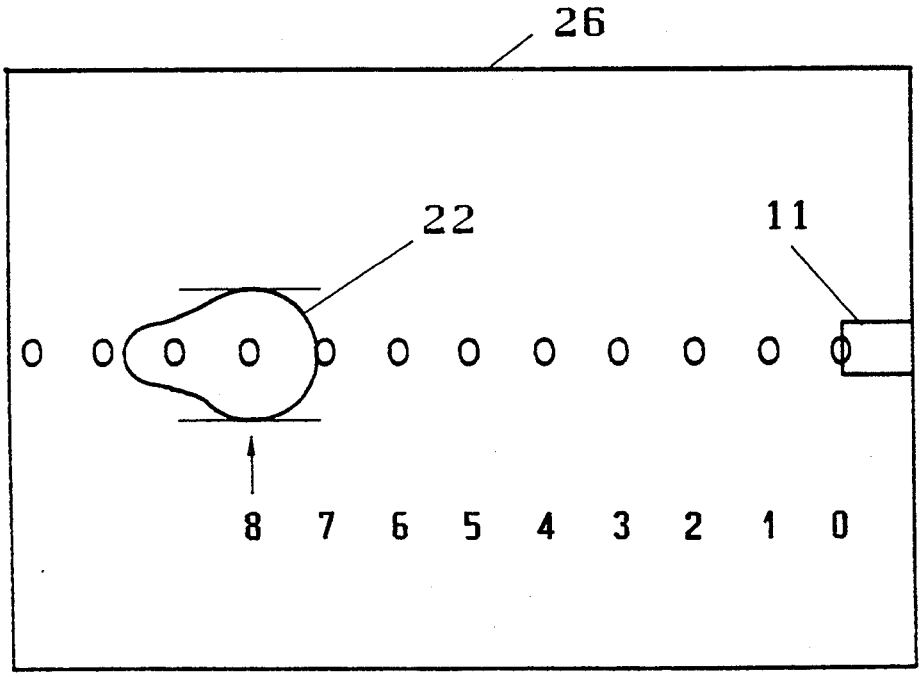
FIG. 4 shows a video monitor screen as it might appear during the performance of a ceramic welding process performed in accordance with this invention.

Such a video monitor screen is shown at 26 in FIG. 4. On that screen, the outlet end 11 of the lance will register as a dark silhouette, and the ceramic welding reaction zone 22 which is spaced from that outlet end by a given working distance will show as an bright, incandescent area. The calibration spots indicated at 0 to 8 may be presented either as white or as black on the screen. The remainder of the screen area will be an intermediate shade of grey assuming that a monochrome monitor is used.

It will be seen that the reaction zone 22 is represented as a circular area with a lobe projecting from one side. Because of the intense heat evolved during the ceramic welding operation, the wall area being repaired is also heated, and as the lance is played across the repair site, an increment of its area which has been subjected to the direct effects of the reaction zone may continue to glow so that it radiates sufficient energy to register on the monitoring equipment. The appearance of such a lobe may be and preferably is attenuated by using a filter which screens off radiation having wavelengths shorter than 670 nm.

Various degrees of sophistication are possible in monitoring the distance between the reaction zone 22 at the working area and the outlet end 11 of the lance, depending on the degree of accuracy required.

For example, considering FIG. 4, a brightness threshold could readily be established to give an indication of the start of the reaction zone, on the right-hand side of that zone as shown in that Figure. Looking at FIG. 4, this would give an indication that the working distance was 7 units. But it may be that the reaction zone will fluctuate in size from time to time depending on operating conditions and that what is required is the distance from the center of the reaction zone. This may be approximated by also taking a brightness threshold applicable to the end of the reaction zone at the left hand side of FIG. 4 to give an average result: such working distance would be about 8½ units. Either of these methods may also be used when the CCD camera used is a linear camera rather than a camera giving a full two-dimensional representation of the work as shown on the video monitor screen illustrated by FIG. 4.

On a more sophisticated level, the signals from the CCD camera may be monitored to give an indication of the location where the image of the reaction zone of FIG. 4 has its greatest height. This will give a more accurate indication of the center of the reaction zone which is at a working distance of 8 units in FIG. 4. This degree of sophistication requires the use of a full two-dimensional camera.

It is not of any great significance that different numerical results are given for what is in fact the same working gap by these different methods. Assuming that the reaction zone depicted in FIG. 4 is at the optimum working distance from the outlet end of the lance, one would simply call that optimum distance 7, 8½ or 8 distance units as the case might be, and working tolerances would be based on the appropriate optimum value for the working distance.

Whether working with a linear or a two-dimensional camera, it is not necessary to display a visible image, though doing so is very much preferred. Those same signals that would be used to control the video screen could be passed to a processor to give an indication of the distance between the reaction zone and the lance outlet end. The processor output could be used to control a digital or analogue display giving an indication of the working distance at any given time. Alternatively, or in addition, such a processor could be used to control an audible signal generator. The arrangement could for example be such that when the working distance was within a small tolerance of the optimum working distance (whatever the latter was set at) no audible signal was given. The signal generator might be set to give an audible signal of increasing pitch and volume as the working distance decreased below the tolerance range, and a lower pitch signal of increasing volume as the working distance increased beyond the tolerance range. Another option is for the camera signals to be passed to a computer arranged to control a welding robot.

It will be appreciated that any of the arrangements described in the immediately preceding paragraph could also be used in conjunction with a video display as described with reference to FIG. 4, and in particular that a digital indication of the working distance at any given time could be displayed on such a video screen.

Also with reference to FIG. 4, it will be appreciated that it is not essential to display, or indeed to monitor, the full extent of the working gap and the outlet end of the lance used. When the camera 17 is mounted in a fixed location and with a fixed orientation with respect to the lance outlet, then the notional position of that outlet is known whether it is displayed or not. If it is known that the correct working distance will never be less than, for example. 2 units, then there is no need to display the lance end or those two units of the working distance. It will be appreciated, however, that useful information about conditions in the immediate vicinity of the lance outlet may be derived if the full extent of the working distance and that outlet are monitored.

It will also be appreciated that it is not essential for the performance of at least the method of the invention that the CCD camera should be fixed to the lance. It might be a quite separate piece of equipment, and still give useful results. This can be done in the following way. The CCD camera is manipulated so that it views the working distance including the outlet end of the lance and the reaction zone much as illustrated in FIG. 4. As before, the CCD camera will view the end of the lance as a dark silhouette and the reaction zone as a bright area. The apparent separation of the reaction zone and the outlet end of the lance as recorded in the focal plane of the camera can readily be derived in a processor fed with signals from the camera. Also, the apparent size of the outlet end of the lance can be derived. Since the outlet end of the lance is of known diameter, it is not difficult to arrange for the processor to convert the apparent separation of the reaction zone and the outlet end of the lance into an approximate linear measurement of the working distance. A continuous re-assessment of the working distance would take place during the welding operation in order to take account of changes in the relative positions of the welding lance and the camera. As before, a synthesised scale and/or a digital indication of the working distance may be fed to a video monitor screen along with the image viewed by the camera, and/or other visible or audible signals may be generated to give an indication of the actual working distance as compared with the optimum working distance.

What is claimed is:

1. In a ceramic welding process in which a mixture of refractory and fuel particles is projected in a gas stream from a lance through a lance outlet against a target surface where the fuel particles combust in a reaction zone at the target surface to produce heat which at least softens or melts the projected refractory particles and thereby form a coherent refractory weld mass on the target surface, the improvement comprising:

measuring an actual working distance between the lance outlet and the reaction zone during projecting of the refractory and fuel particles in a gas stream from the lance by:

(a) positioning a camera, which is a charged-coupled device ("CCD") camera, to monitor the reaction zone and at least a part of the actual working distance between the lance outlet and the reaction zone, and to produce a first electronic signal which corresponds to images recorded by the camera and which is indicative of at least part of the actual working distance between the lance outlet and the reaction zone; and (b) adjusting the first electronic signal to produce a second electronic signal which is indicative of the actual working distance.

2. The method according to claim 1, wherein a signal which is one of an audible signal or a visual signal is generated to distinguish between operating conditions in which (a) the actual working distance falls within a tolerance range of a desired working distance, which desired working distance ranges from 5 to 10 cm, and (b) the actual working distance falls outside the tolerance range of the desired working distance.

3. The method according to claim 1, wherein the camera is positioned to be independently movable with respect to the lance and is used simultaneously to monitor the positions of the lance outlet and the reaction zone.

4. The method according to claim 3, wherein a third electronic signal is generated which is proportional to the size of the image of the lance outlet and the third electronic signal is used as a scaling factor for an image of the actual working distance between the reaction zone and the lance outlet.

5. The method according to claim 1, wherein the camera is positioned by being mounted in a fixed position and orientation on the lance.

6. The method according to claim 1, wherein the first electronic signal produced by the camera is used to generate an image on a video monitor screen.

7. The method according to claim 6, wherein the video monitor screen is used to display an image of the reaction zone superimposed on a calibration scale.

* * * * *